US006171003B1

(12) United States Patent
Lo

(10) Patent No.: US 6,171,003 B1
(45) Date of Patent: Jan. 9, 2001

(54) LOW NOISE KEY STRUCTURE OF COMPUTER KEYBOARD

(75) Inventor: Chi Lung Lo, Taipei (TW)

(73) Assignee: Behavior Tech Computer Corp., Taipei (TW)

( * ) Notice: Under 35 U.S.C. 154(b), the term of this patent shall be extended for 0 days.

(21) Appl. No.: 09/401,540

(22) Filed: Sep. 22, 1999

(51) Int. Cl.[7] ..... B41J 5/12
(52) U.S. Cl. ..... 400/495; 400/490
(58) Field of Search ..... 400/495, 491.2, 400/490, 472; 361/680; 200/345, 344, 343

(56) References Cited

U.S. PATENT DOCUMENTS 5,209,588 * 5/1993 Chen ..... 400/490
5,333,961 * 8/1994 Capigatti et al. ..... 400/490
5,372,442 * 12/1994 Wang ..... 400/495
5,496,982 * 3/1996 Tsai ..... 200/345
5,669,723 * 9/1997 Chang ..... 400/496
5,907,612 * 8/1999 Aggus et al. ..... 379/368
5,938,009 * 8/1999 Huang ..... 200/517

* cited by examiner

*Primary Examiner*—John S. Hilten
*Assistant Examiner*—Anthony H. Nguyen
(74) *Attorney, Agent, or Firm*—Rosenberg, Klein & Lee

(57) ABSTRACT

A key structure of a computer keyboard includes a cap and a post axially extending from an underside of the cap and being movably inserted into and received in a guide channel of the keyboard. The post has a quadrilateral cross section having pairs of opposite first and second side faces. Each first side face forms two first resilient members each having a contacting portion of a V-shaped configuration laterally extending beyond the post for biasingly engaging with a corresponding inside surface of the guide channel thereby stabilizing the movement of the key with respect to the guide channel and thus reducing the noise level thereof. Each second side face forms a second resilient member defining an elongate slot movably receiving and engaging with a corresponding stop block formed inside the guide channel. The engagement between the slot and the stop block limits the stroke of movement of the key thereby preventing the post from severely impacting and thus damaging the keyboard and associated parts thereof.

8 Claims, 4 Drawing Sheets

LOW NOISE KEY STRUCTURE OF COMPUTER KEYBOARD

FIELD OF THE INVENTION

The present invention generally relates to a key structure of a computer keyboard, and in particular to a key structure having reduced noise level during operation thereof.

BACKGROUND OF THE INVENTION

Keyboards are commonly used computer input devices. A computer keyboard comprises a base on which a plurality of keys movably supported by corresponding resilient biasing members. The keys, when struck by a user, move toward the base of the keyboard and deforms the corresponding biasing member to contact and trigger an associated circuit for generating a corresponding signal. The keys have a cap from which a post extends. The post is movably received in a guide channel formed in the keyboard base for guiding the movement of the key. Examples of the conventional key structure are disclosed in Taiwan Patent Publication Nos. 81207039 and 81209527.

A drawback of the conventional key structure is that the stroke of the keys is in general not specifically limited. In other words, the movement of the keys cannot be stopped until they hit the base of the keyboard. Under such a condition, the resilient biasing members of the keyboard that are deformed by the movement of the keys will be subject to a severe impact and deformation thereby shortening the service life thereof. In addition, the strong hit of the post on the associated circuit may cause damage to the circuit.

Furthermore, the post of the cap is loosely received in the guide channel whereby the movement of the post with respect to the guide channel is not well guided leading to unstable operation thereof and a high level of noise. In addition, the loose engagement between the post and the guide channel allows the key to be quickly returned to its un-struck position by the resiliency of the corresponding biasing member of the keyboard the when the striking force is removed. This quick movement also causes a high level noise and potential damage to the keyboard.

Thus, it is desired to provide an improved key structure of a computer keyboard that overcomes the above-discussed problems.

SUMMARY OF THE INVENTION

Accordingly, an object of the present invention is to provide a key structure of a computer keyboard which extends the service life of the keyboard.

Another object of the present invention is to provide a key structure of a computer keyboard having a reduced level of noise during operation thereof.

A further object of the present invention is to provide a key structure of a computer keyboard providing a stable operation.

A further object of the present invention is to provide a key structure of a computer keyboard of which a stroke thereof is limited by an additional stop member thereby reducing the likelihood of damage caused by severe impact.

A further object of the present invention is to provide a key structure of a computer keyboard wherein the movement of the key with respect to a guide channel of the keyboard is smooth and stable.

To achieve the above object, in accordance with the present invention, there is provided a key structure of a computer keyboard comprising a cap and a post axially extending from an underside of the cap and being movably inserted into and received in a guide channel of the keyboard. The post has a quadrilateral cross section having pairs of opposite first and second side faces. Each first side face forms two first resilient members each having a contacting portion of a V-shaped configuration laterally extending beyond the post for biasingly engaging with a corresponding inside surface of the guide channel thereby stabilizing the movement of the key with respect to the guide channel and thus reducing the noise level thereof. Each second side face forms a second resilient member defining an elongate slot movably receiving and engaging with a corresponding stop block formed inside the guide channel. The engagement between the slot and the stop block limits the stroke of movement of the key thereby preventing the post from severely impacting and thus damaging the keyboard and associated parts thereof.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
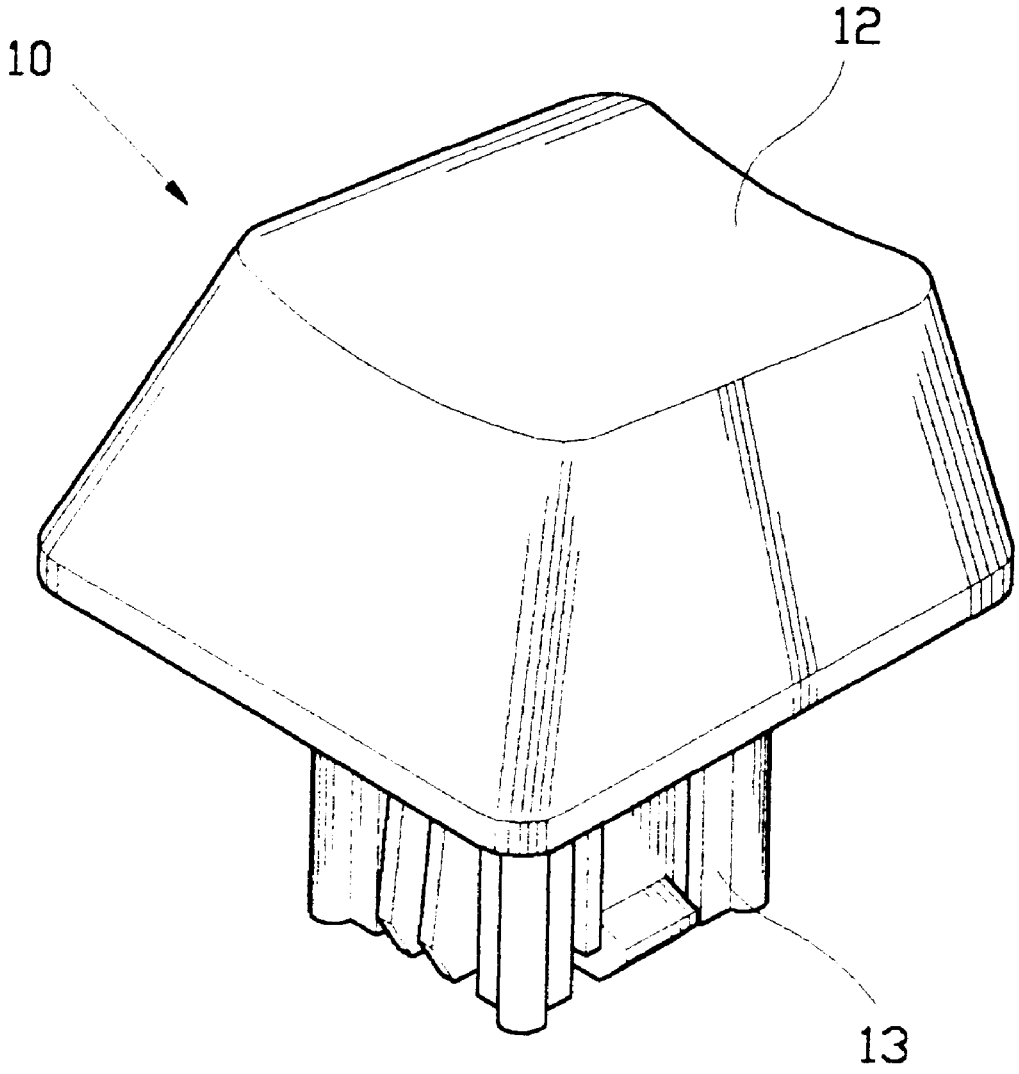
FIG. 1 is a perspective view of a key structure of a computer keyboard constructed in accordance with the present invention.

With reference to the drawings and in particular to FIG. 1, a key of a computer keyboard constructed in accordance with the present invention, generally designated by reference numeral 10, comprises a cap 12 and a post 13 extending from an underside of the cap 12. Preferably, the post 13 is integrally formed with the cap 12. Further referring to FIG. 2, the key 10 is adapted to be movably received in and guided by a guide channel 11 of the keyboard and supported by a resilient biasing member 21 (FIG. 3) arranged on a base of the keyboard (not shown) whereby when the key 10 is struck or depressed by a user, the key 10 moves along the guide channel 11 and compresses/deforms the resilient biasing member 21 for contacting/triggering an associated circuit of the keyboard to generate a corresponding signal. The resiliency of the biasing member 21 returns the key 10 back to its original, un-struck position when the striking force is removed.

In the embodiment illustrated, the post 13 has a quadrilateral cross section, such as square or rectangular, four side faces connected to each other and forming four corners. The guide channel 11 that movably receives the post 13 therein has a corresponding quadrilateral cross section having four chamfered corners 16. A round rib 15 is formed on each comer of the post 13 and extends therealong. The round rib 15 snugly and slidably engages with the corresponding comer 16 of the guide channel 11.

Figure 3:
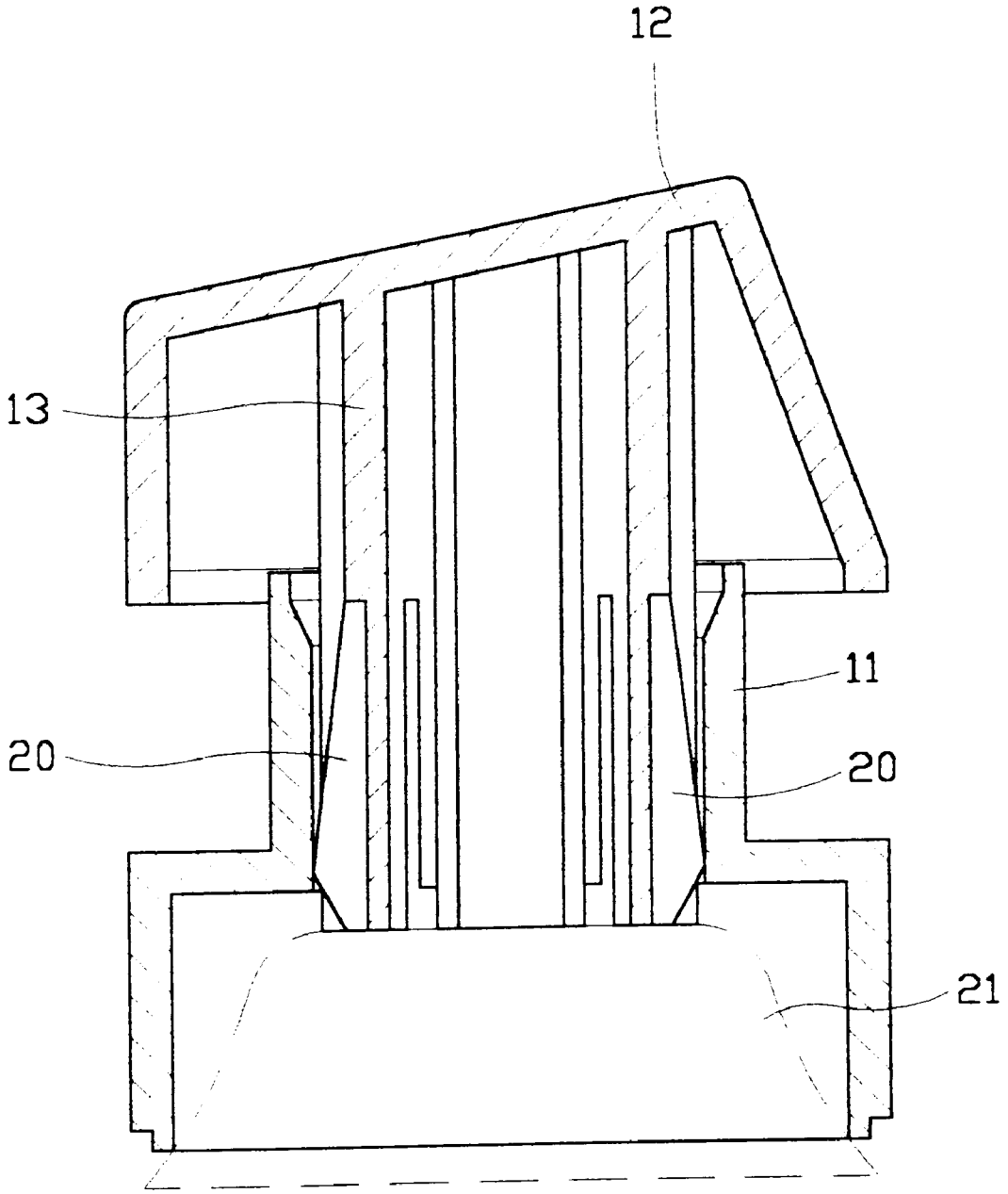
FIG. 3 is a cross-sectional view showing the key received in the guide channel of the keyboard.

Also referring to FIG. 3, at least one first resilient member 20 is formed on each of a pair of opposite first side faces of the post 13. Preferably, the first resilient member 20 is integrally formed with the post 13. In the embodiment, each first side face comprises two spaced first resilient members 20. Each first resilient member 20 forms a contacting portion extending beyond the corresponding first side face of the post 13. In the embodiment illustrated, the contacting portion of each first resilient member 20 is V-shaped having top and bottom inclination. The contacting portions of the first resilient members 20 are elastically and inward deformed when the post 13 is received in the guide channel 11 and are biased by the resiliency thereof to engage with corresponding inside surfaces of the guide channel 11 whereby the movement of the key 10 is stably supported in the guide channel 11.

In addition, a dragging force is caused by friction between the first resilient members 20 and the corresponding inside surfaces of the guide channel 11 and is applied to the post 13 when the key 10 is moved with respect to the guide channel 11. After the key 10 is struck and the striking force is removed, the key 10 is returned to its original un-struck position by the resiliency of the biasing member 21 of the keyboard. In accordance with the present invention, the dragging force applied to the post 13 by the first resilient members 20 thereof serves to reduce the speed of the key 10 in moving back to the original position thereby reducing the likelihood of damage caused by impact and noise caused by the movement of the key 10.

Figure 2:
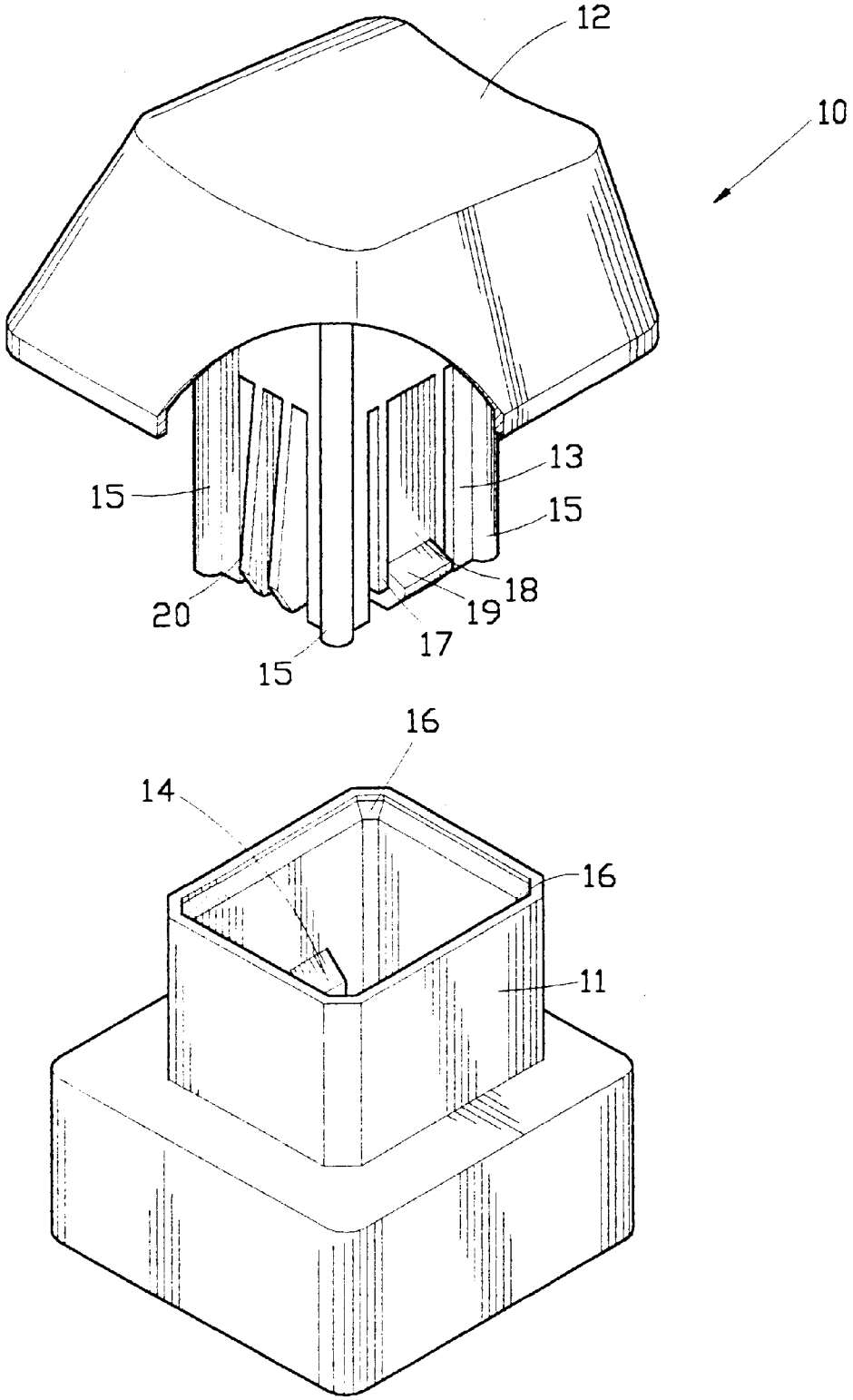
FIG. 2 is similar to FIG. 1 with the key being partially broken away for showing inside details thereof, a guide channel of the keyboard being shown for movably receiving the key.
Figure 4:
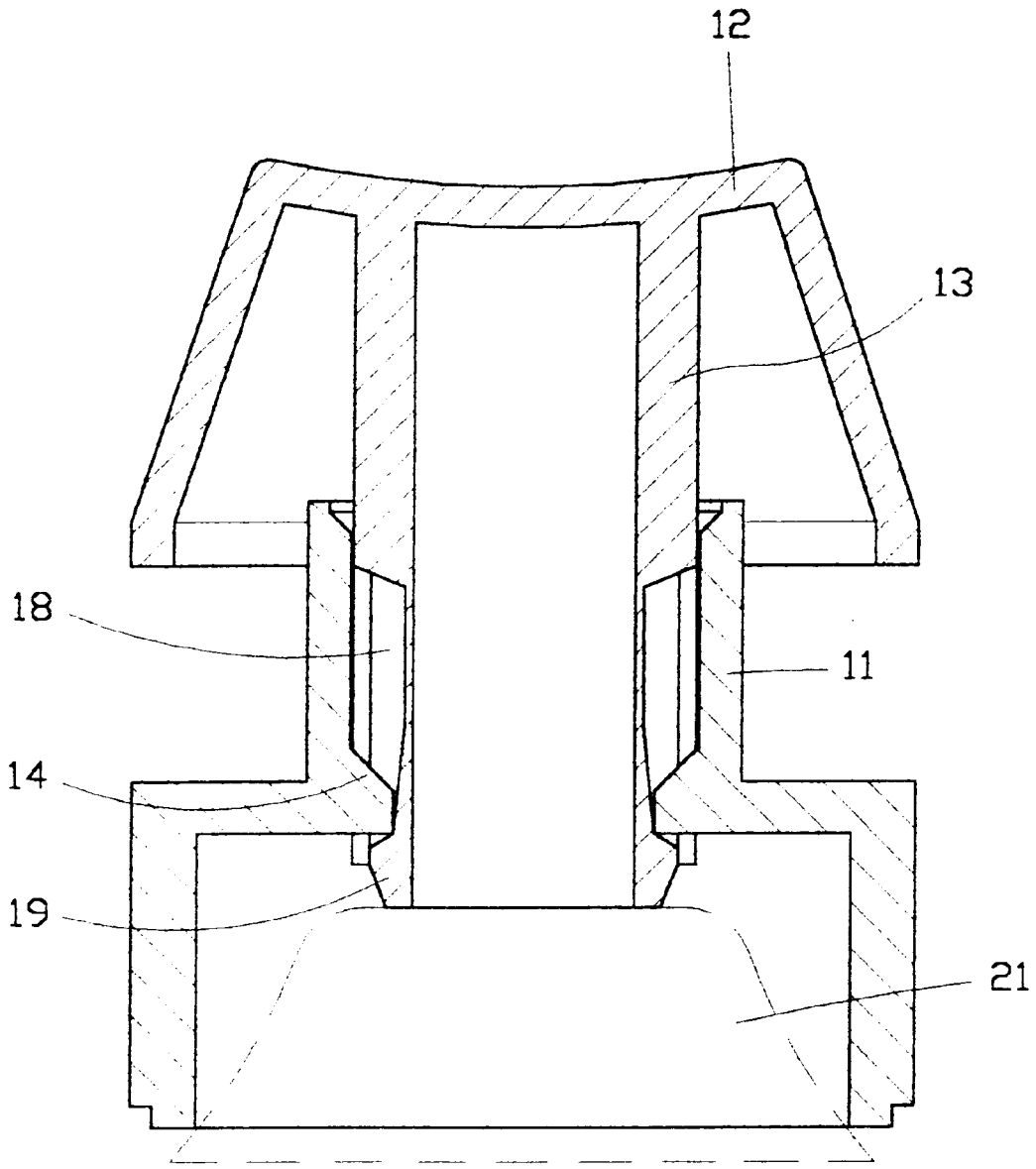
FIG. 4 is another cross-sectional view showing the key received in the guide channel of the keyboard.

Referring to FIGS. 2 and 4, a second resilient member 17 is formed in each of a pair of opposite second side faces of the post 13. Preferably, the second member 17 is integrally formed with the post 13. The second resilient member 17 defines an elongated slot 18 extending in a direction parallel to the post 13. A protrusion 19 is formed on a lower end of the second resilient member 17. Preferably, the protrusion 19 has upper and lower inclined surfaces. When the post 13 is inserted into the guide channel 11, the protrusion 19 of each second resilient member 17 engages with and slides over a stop block 14 formed on a corresponding inside surface of the guide channel 11. The inclined surfaces of the protrusion 19 facilitate the protrusion 19 sliding over the stop block 14. Preferably, the stop block 14 has a corresponding inclined surface. The protrusion 19, after sliding over the stop block 14, engages with and is retained within the slot 18. The length of the slot 18 limits the stroke of the movement of the key 10 thereby preventing the key 10 from heavily hitting and potentially damaging the biasing member 21 of the keyboard.

Although the post 13 in the embodiment illustrated is square or rectangular in cross section, it may be circular and has a circular circumference with the first and second resilient members 20, 17 alternately arranged.

Although the present invention has been described with respect to the preferred embodiment, it is contemplated that a variety of modifications, variations and substitutions may be done without departing from the scope of the present invention that is intended to be defined by the appended claims.

What is claimed is:

1. A key structure of a computer keyboard, comprising:

(a) a cap member having a top surface and side walls extending from said top surface of said cap member;

(b) a post member extending axially from said top surface of said cap member within a periphery of said side walls, said post member being formed of a pair of opposing first side walls and of a pair of opposing second side walls, a pair of first resilient members, each formed on a respective one of said pair of first side walls of said post member and extending outwardly from an outer surface thereof, a pair of second resilient members, each formed on a respective one of said pair of second side walls of said post member, each said second resilient member defining an elongated slot extending along said respective second side wall of said post member and further having a protrusion member formed at a lower end of said elongated slot and extending outwardly therefrom; and (c) a guide channel formed in the keyboard, said guide channel having a pair of opposing third side walls and a pair of opposing fourth side walls arranged to form an internal path of said guide channel, and a pair of stop blocks, each stop block being respectively formed on an inside surface of said fourth side walls of said guide channel;

said post member being slidably received within said internal path of said guide channel, said first resilient members resiliently engaging with an inner surface of said third side walls, and said protrusion member of said second resilient members resiliently contacting a respective one of said stop blocks on said fourth side walls, thereby stabilizing the motion of said post member within said guide channel, and thereby reducing unwanted excessive interaction between said key structure and the keyboard.

2. The key structure as claimed in claim 1 further including a set of said first resilient members on each of said first side walls of said post member, each said set including two of said first resilient members in spaced relationship.

3. The key structure as claimed in claim 1, wherein each said first resilient member has a contacting portion with a V-shaped configuration having an upper and a lower inclined surface, said contacting portion making contact with said inner surface of said third side walls of said guide channel.

4. The key structure as claimed in claim 1, wherein each said second resilient member is deformable for allowing the stop block to move into said elongated slot when said post member is positioned within said guide channel.

5. The key structure as claimed in claim 4, wherein said protrusion member of said second resilient member and said stop block have respective engaging inclined surfaces formed thereon for facilitating the stop block to access said elongated slot.

6. The key structure as claimed in claim 1, wherein said first resilient members and said second resilient members are arranged alternately along a circumferential surface of said post member.

7. The key structure as recited in claim 6, wherein said post member has a quadrilateral cross section having two of said first resilient members formed on each of said first side walls thereof and two of said second resilient members formed on each of said second side walls of said post member.

8. The key structure as claimed in claim 7, wherein said guide channel has four corners formed between said third and fourth side walls thereof, and wherein said post member has four round ribs each extending at joints formed between said first and second side walls thereof, each said round rib snugly and slidably engaging with a respective one of said corners of the guide channel.

* * * * *